US006568602B1

(12) United States Patent
Bram et al.

(10) Patent No.: US 6,568,602 B1
(45) Date of Patent: May 27, 2003

(54) VARIABLE CHECK STOP FOR MICROMETERING IN A FUEL INJECTOR

(75) Inventors: Eric M. Bram, Peoria; Manas R. Satapathy, Aurora, both of IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/575,906

(22) Filed: May 23, 2000

(51) Int. Cl.[7] ..... F02D 1/06; B05B 1/08

(52) U.S. Cl. ..... 239/5; 239/102.2; 239/533.3; 239/533.9; 239/533.4; 251/129.06

(58) Field of Search ..... 239/533.1, 533.2, 239/533.3, 533.9, 533.4, 5, 102.1, 102.2; 251/129.06, 89.5, 95

(56) References Cited

U.S. PATENT DOCUMENTS

| | | | | |
|---|---|---|---|---|
| 3,055,631 A | | 9/1962 | Kippenhan | |
| 4,176,822 A | | 12/1979 | Chadwick | |
| 4,284,263 A | | 8/1981 | Newcomb | |
| 4,399,793 A | | 8/1983 | Poore et al. | |
| 4,566,635 A | | 1/1986 | Trachte | |
| 4,584,980 A | | 4/1986 | Weiger et al. | |
| 4,635,849 A | * | 1/1987 | Igashira et al. | 239/102.2 |
| 4,637,553 A | | 1/1987 | Kushida et al. | |
| 4,725,002 A | * | 2/1988 | Trachte | 239/102.2 |
| 4,750,706 A | | 6/1988 | Schlagmuller | |
| 4,782,803 A | | 11/1988 | Kikuchi | |
| 4,798,188 A | | 1/1989 | Ito et al. | |
| 4,907,748 A | | 3/1990 | Gardner et al. | |
| 4,943,004 A | | 7/1990 | Takahashi | |
| 4,971,290 A | | 11/1990 | Dahlmann | |
| 5,141,164 A | | 8/1992 | Ohno et al. | |
| 5,154,350 A | | 10/1992 | Ausiello et al. | |
| 5,222,713 A | | 6/1993 | Lawless et al. | |
| 5,323,964 A | | 6/1994 | Doszpoly et al. | |
| 5,505,384 A | | 4/1996 | Camplin | |
| 5,553,828 A | | 9/1996 | Jaenker | |
| 5,752,659 A | | 5/1998 | Moncelle | |
| 5,810,255 A | * | 9/1998 | Itoh et al. | 239/533.3 X |
| 5,884,848 A | | 3/1999 | Crofts et al. | |
| 5,894,992 A | | 4/1999 | Liu et al. | |
| 6,062,489 A | * | 5/2000 | Tokumaru | 239/533.9 X |
| 6,065,450 A | | 5/2000 | Chen et al. | |
| 6,196,472 B1 | * | 3/2001 | Cooke | 239/102.2 X |

FOREIGN PATENT DOCUMENTS

| | | |
|---|---|---|
| JP | 59023061 | 2/1984 |
| JP | 60116857 | 6/1985 |

* cited by examiner

*Primary Examiner*—Steven J. Ganey
(74) *Attorney, Agent, or Firm*—Eric Bram; Mike R Huber

(57) ABSTRACT

A fuel injector performs main fuel injection by raising fuel pressure in a nozzle chamber to lift a check valve member to a fully open position, and performs preinjection or micro-injection by operating a solid state motor to lower a check stop so that when fuel pressure in the nozzle chamber is raised the check valve member is limited to lift a much smaller distance.

7 Claims, 4 Drawing Sheets

VARIABLE CHECK STOP FOR MICROMETERING IN A FUEL INJECTOR

TECHNICAL FIELD

This invention relates generally to fuel injectors utilizing check valves, and more particularly to micrometering or varying fuel injection rates by using a variable-position check stop.

BACKGROUND ART

Over time, engineers have come to recognize that undesirable exhaust emissions can be reduced by having the ability to produce at least three different fuel injection rate shapes across the operating range of a given engine. These rate shapes include a ramp, a boot shape, and square fuel injection profiles. Engineers believe that by injecting a small amount of fuel just before main fuel injection to "prime" a fuel combustion chamber undesirable exhaust emissions can be reduced.

In addition, engineers also believe that by producing a "split injection" of varying quantities of fuel, combustion efficiency at some operating conditions, such as at idle, can be improved, and noise (especially at idle) can be reduced.

Although there exist a wide variety of mechanisms for pressurizing fuel in fuel injection systems, almost all fuel injectors include a spring biased needle check valve to open and close the nozzle outlet. In almost all fuel injectors, the needle valve member is only stoppable at two different positions: fully open or fully closed. Because the needle valve members in these fuel injectors are not normally stoppable at a partially open position, fuel injection mass flow can usually be controlled only through changes in fuel pressure.

Hydraulic bias control of the check valve is also possible, such as taught in U.S. Pat. No. 6,024,296 to Wear et al. Dual-stage spring nozzles have also been used, but these can produce slower injection rate changes than desired. Another approach is dual nozzle design, but this is an expensive solution.

It would be advantageous to have a reliable mechanism for accurately varying maximum check lift for rate shaping purposes. For example, being able to selectively reduce maximum lift of the check valve member from one shot to the next could help provide pre-metering or micrometering—that is, injecting a very small amount of fuel prior to a main injection. This could improve operation of the fuel injector, especially to reduce noxious emissions and/or to reduce noise of operation, as explained above. Variable check lift could be advantageous for other purposes as well. Accurate methods of achieving very small fuel volume pre-metering or micrometering are always of interest.

The present invention is directed to addressing these and other concerns associated with controlling needle valve lift within fuel injectors.

DISCLOSURE OF THE INVENTION

In one aspect of the invention, a fuel injector comprises a nozzle at least partially defining a nozzle chamber and at least one nozzle orifice. A check stop in the nozzle body is comprised by a solid state motor operable to move the check stop between a protruded position and a receded position. A check valve member extends into the nozzle chamber and is slidably disposed in a nozzle body. Sliding motion of the check valve member is limited in a first direction to a closed position in which the check valve member obstructs fluid communication between the nozzle chamber and the nozzle orifice, and is limited in a second direction by the check stop.

In another aspect of the invention, a method for operating a fuel injector is disclosed. The fuel injector comprises a nozzle body including a nozzle, a check stop, and a check valve member. The nozzle at least partially defines a nozzle chamber and at least one nozzle orifice. The check stop comprises a solid state motor. The check valve member extends into the nozzle chamber and is slidable between a closed position in which the nozzle chamber is fluidly isolated from the nozzle orifice and a fully open position in which the nozzle chamber is in fluid communication with the nozzle orifice.

Pressurized fuel is supplied to the nozzle chamber. The solid state motor is operated to position the check stop at a receded position and at a protruded position. The check valve member is positioned at the closed position.

Fuel is injected from the nozzle orifice at a main injection rate by moving the check valve member to the fully open position. Fuel is injected from the nozzle orifice at a micrometering rate less than the main injection rate by positioning the check valve member at a micrometering position, between the closed position and the fully open position, in which further motion of the check valve member toward the fully open position is blocked by the check stop at the protruded position.

BRIEF DESCRIPTION OF THE DRAWINGS

Features of the invention can be better understood with reference to the drawing figures, in which certain dimensions may be exaggerated to illustrate check valve movement for example, and in which.

BEST MODE FOR CARRYING OUT THE INVENTION

The invention is now described with reference to FIGS. 1–4*b*, which illustrate a fuel injector 10 and check valve portion 12 thereof utilizing the invention.

Figure 1:
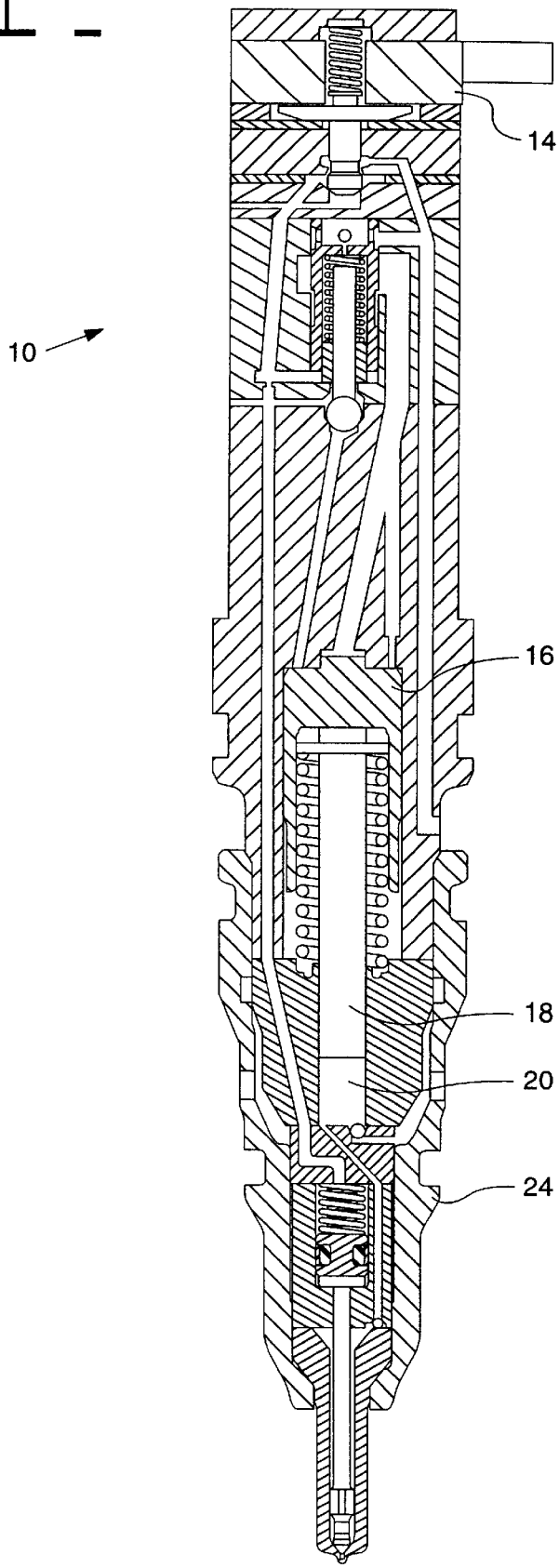
FIG. 1 is a diagrammatic side view representation of a fuel injector utilizing a variable-position check stop according to the invention.

The fuel injector 10 in this embodiment, shown in FIG. 1, is a hydraulically actuated fuel injector and has an electronically controlled actuator 14. In the illustrated embodiment the actuator 14 utilizes a solenoid, but other types of electronically controlled actuators, for example piezo or magnetostrictive, may be used. In other embodiments mechanical actuators may be used.

An intensifier piston 16 is slidably disposed in the fuel injector 10. Beneath the intensifier piston 16 is a plunger 18 partially defining a fuel pressure control cavity 20. In other embodiments the plunger 18 may be integral with the intensifier piston 16.

FIGS. 2–4*b* show a check valve portion 12 of the fuel injector 10 in greater detail. A solid state motor 22 is disposed in a nozzle body 24 above a check valve member 26. The solid state motor 22 can be an expansion device composed of any electrically or magnetically expandable material, piezo or magnetostrictive for example. The device or the material from which it is made may expand when energized, as with a standard piezo stack for example, or may contract when energized, for example as when using a thermally pre-stressed, bending unimorph piezo device comprising ferroelectric wafers such as those described in U.S. Pat. No. 5,632,841 assigned to the National Aeronautics and Space Administration (NASA).

The check valve member 26 is slidably disposed in a check bore 28 in the nozzle body 24, and extends into a nozzle chamber 30 in a nozzle 32. The nozzle 32 has at least one nozzle orifice 34. Above the check valve member 26 is a check piston 36 that can be a separate piece from the check valve member 26 as in the illustrated embodiment, or can be attached to, or even be integral with, the check valve member 26.

In the embodiment illustrated in FIGS. 1–4*a* the check piston 36 incorporates a glide ring seal 38 comprising a rubber energizer or O-ring 40 and a nylon wear surface 42. The check piston 36 with the glide ring seal 38 is slidably disposed in a check piston bore 44. FIG. 4*b* shows an alternate embodiment of a check piston 36' without the glide ring seal 38.

A check control chamber 46 is partially defined by a closing surface 48 of the check piston 36. A mechanical bias 50 such as a spring (FIG. 4*a*) for example in the check control chamber 46 pushes downward on the check piston 36. (To more clearly illustrate the invention, the mechanical bias 50 is omitted from FIGS. 2 and 3.) A lower surface of the solid state motor 22 acts as a variable-position check stop 52 and is disposed in the check control chamber 46 opposite the closing surface 48 of the check piston 36 in the illustrated embodiment.

Industrial Applicability

The fuel injector 10 in the illustrated embodiment of FIG. 1 is a hydraulically actuated fuel injector with direct check control utilizing the invention. Of course, it will be understood that the invention can also be practiced in a hydraulically actuated fuel injector without direct check control, as well as in a non-hydraulically (i.e., mechanically) actuated fuel injector with or without direct check control.

Figure 2:
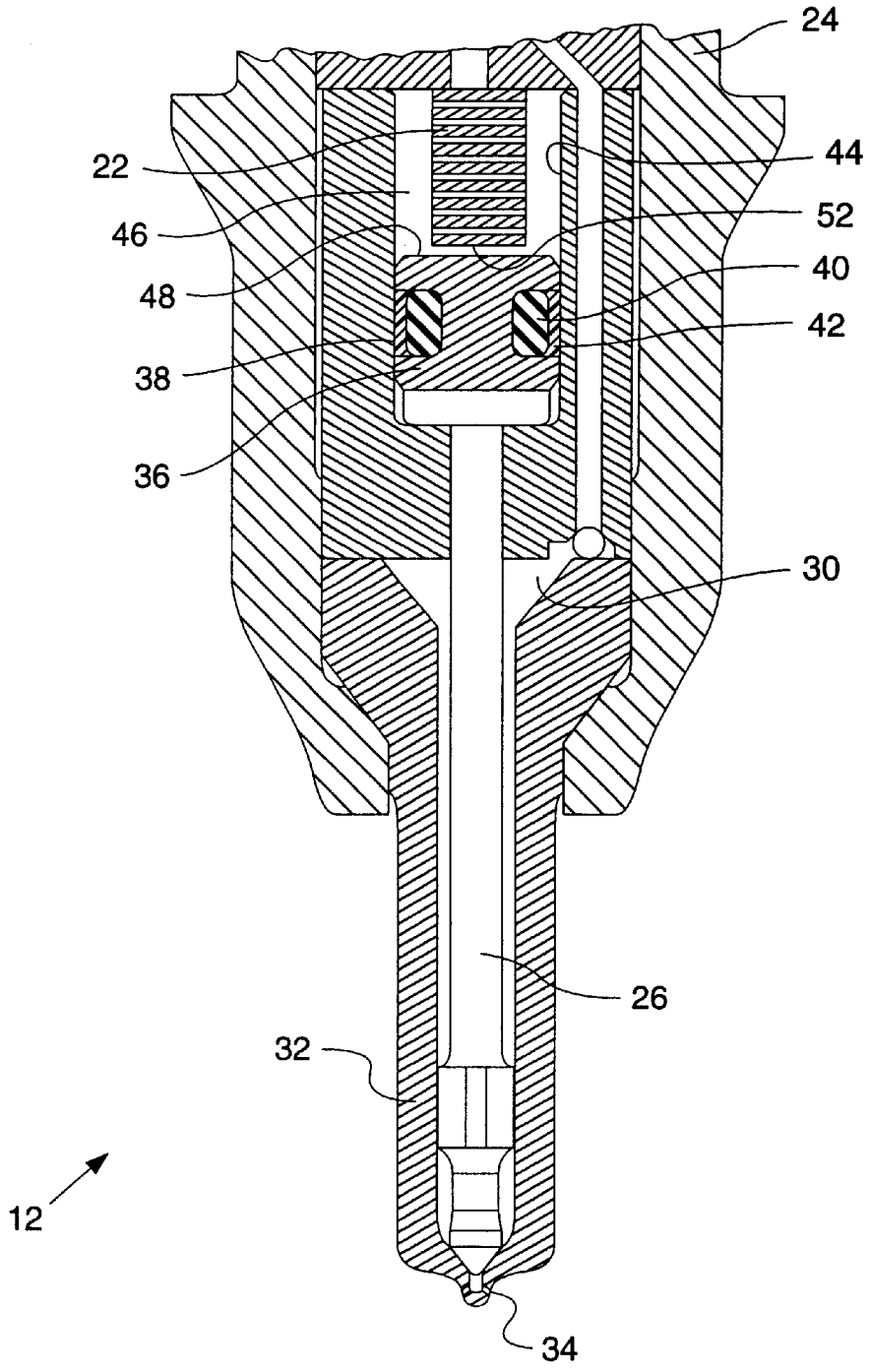
FIG. 2 is a diagrammatic side view representation of a check valve portion of the fuel injector of FIG. 1 with the check in a closed position and the check stop at a protruded position.

Referring now to FIG. 2, fuel injection occurs when the check valve member 26 is pulled or pushed upward so that high pressure fuel in the nozzle chamber 30 can pass through the nozzle orifice 34. Usually there will be more than one nozzle orifice 34 arranged for efficient fuel injection.

The check valve member 26 is usually biased downward to keep it from opening, that is, to keep the check valve member 26 in a first position, i.e., a "closed" position, in which the check valve member 26 is pressed against the nozzle 32 to fluidly isolate the nozzle orifice 34 from the nozzle chamber 30. This bias may be mechanical or hydraulic, or a combination thereof.

The illustrated embodiment uses both mechanical and (intermittently) hydraulic bias to bias the check valve member 26 toward the closed position. The mechanical bias 50 (FIG. 4*a*) presses downward on the closing surface 48 of the check piston 36. High-pressure hydraulic fluid can be diverted to the check control chamber 46 to apply additional downward bias to the check valve member 26 by applying hydraulic pressure against the closing surface 48 of the check piston 36.

Figure 3:
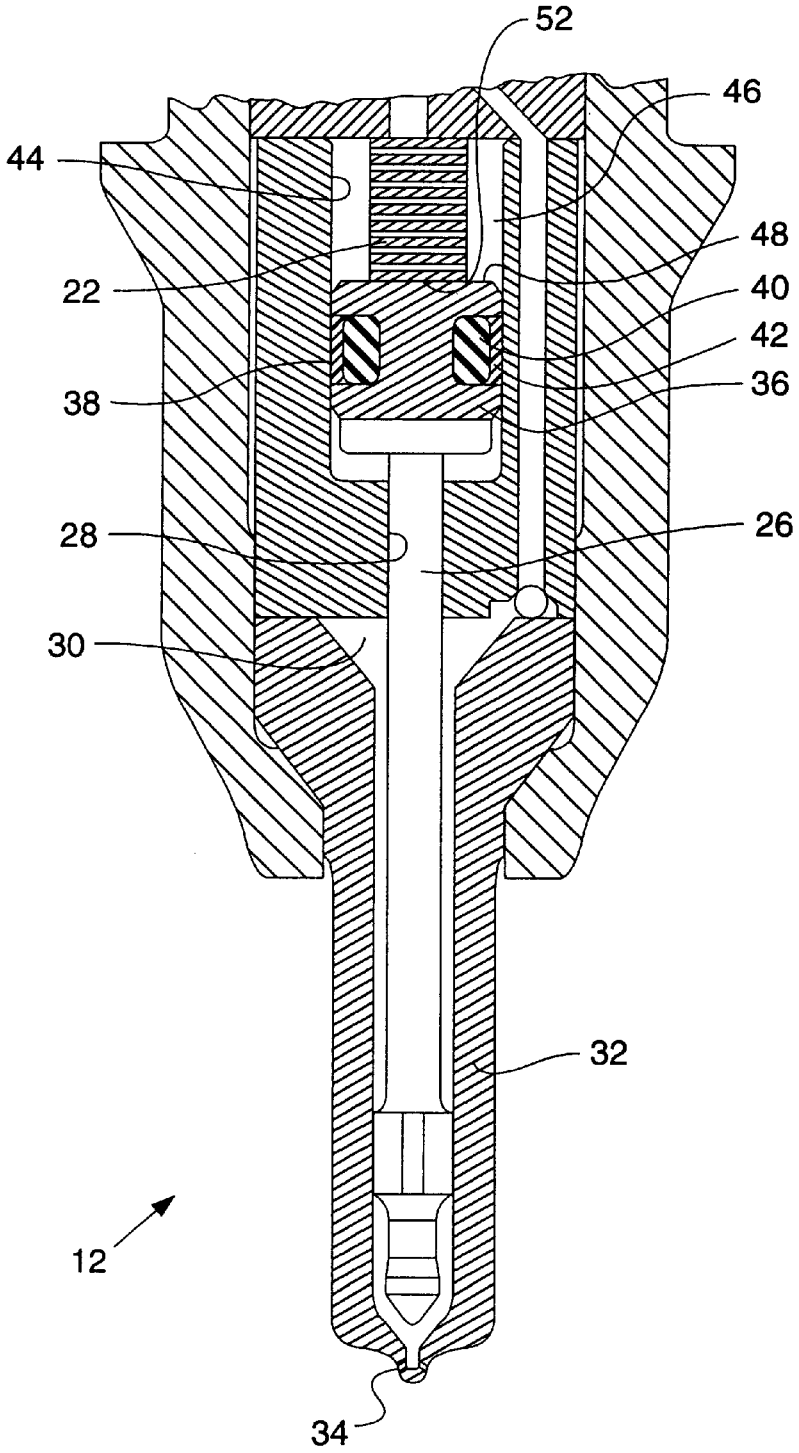
FIG. 3 is a diagrammatic side view representation of the check valve portion of FIG. 2 with the check in a fully open position and the check stop at a receded position.

Referring now to FIG. 3, for main fuel injection, to achieve a main fuel injection rate, the solid state motor 22 is operated to a "contraction" energy state that quickly places the check stop 52 in a higher, "receded" position. Main fuel injection occurs when the check stop 52 is in the receded position and fuel pressure in the nozzle chamber 30 is increased until the fuel pressure in the nozzle chamber 30 overcomes the mechanical and/or hydraulic bias keeping the check valve member 26 in the closed position. When this happens the check valve member 26 slides upward until its movement is stopped by contact with the receded check stop 52. Then the check valve member 26 is in a second position, i.e., a "fully open" position. Using the check stop 52 to stop the check valve member 26 can produce better shot-to-shot performance than relying on a spring or hydraulic bias for example to stop the check valve member 26.

In the illustrated embodiment fuel pressure in the nozzle chamber 30 is increased for main fuel injection by causing the actuator 14 to direct high-pressure actuation fluid to push against the intensifier piston 16. This in turn pushes the plunger 18 further into the fuel pressure control cavity 20, which raises fuel pressure in both the fuel pressure control cavity 20 and in the nozzle chamber 30 to which it is fluidly connected.

Although micrometering injection (discussed below) can be initiated during main fuel injection, main fuel injection normally ends when the total bias pushing the check valve member 26 toward the closed position exceeds the fuel pressure in the nozzle chamber 30. This can be accomplished by reducing fuel pressure in the nozzle chamber 30, by increasing downward bias against the check valve member 26, or by a combination of these two methods.

In the illustrated embodiment fuel pressure in the nozzle chamber 30 can be reduced by operating the actuator 14 to release hydraulic fluid pressure from pushing on the intensifier piston 16, thereby allowing the plunger 18 to move upward again. Of course, in other fuel injector embodiments other methods of increasing and decreasing fuel pressure in the nozzle chamber 30 may be used with the invention.

In the illustrated embodiment the downward bias against the check valve member 26 can be increased to end main fuel injection by operating the actuator 14 to direct high-pressure actuation fluid into the check control chamber 46 as explained above. Of course, in other fuel injector embodiments other methods of increasing downward bias against the check valve member 26 to end main fuel injection may be used with the invention. In some embodiments utilizing the invention a constant mechanical or other bias may be used. In other embodiments utilizing the invention a hydraulic bias, either constant or variable, may be used in place of the mechanical bias 50. Still other embodiments utilizing the invention may use combinations of these methods for providing bias when utilizing the invention.

Figure 4A:
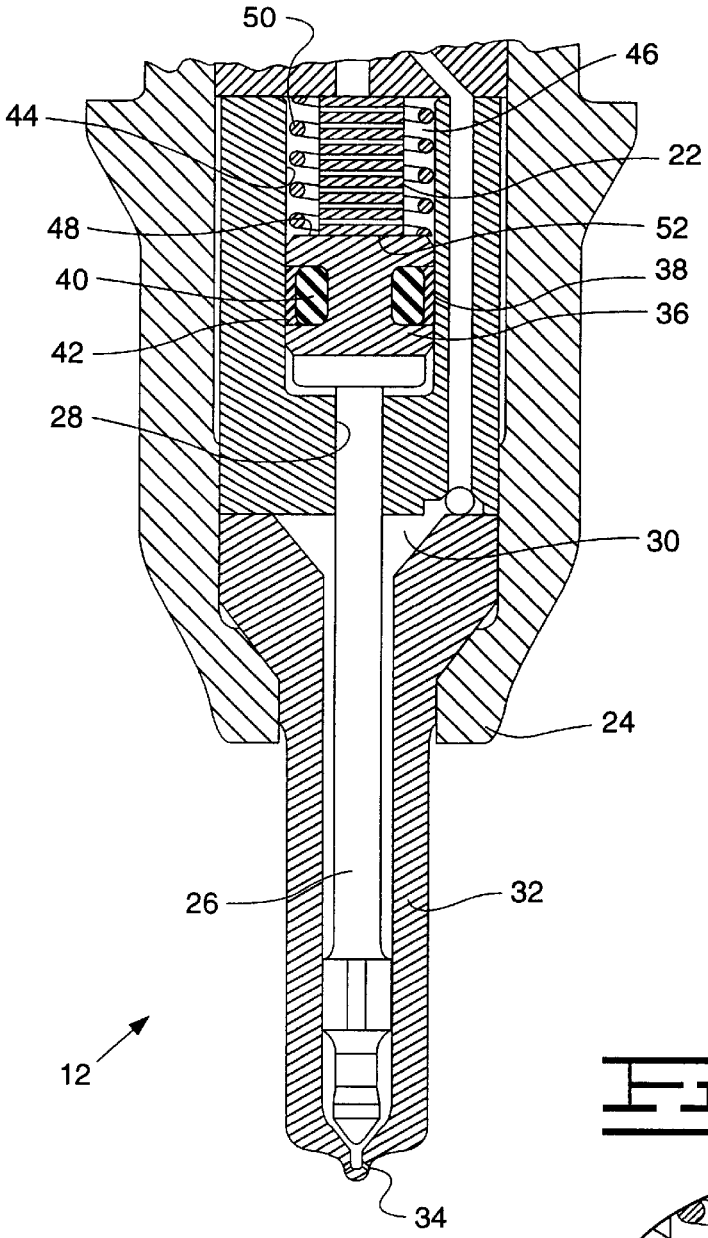
FIG. 4*a* is a diagrammatic side view representation of the check valve portion of FIG. 2 with the check in a micrometering position and the check stop at the protruded position.
Figure 4B:
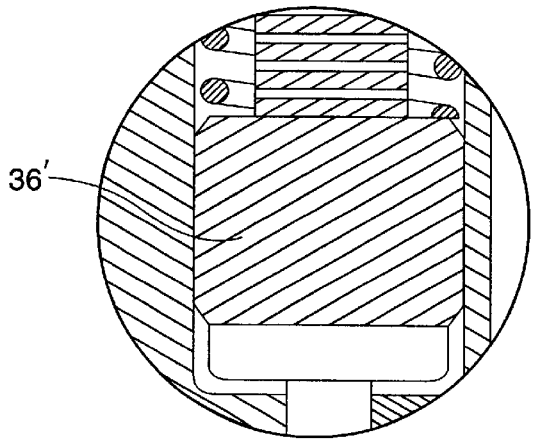
FIG. 4*b* is a diagrammatic side view representation of an alternate embodiment of a check piston that can be used with the invention.

Referring now to FIG. 4*a*, for micrometering injection the solid state motor 22 is operated to an "expansion" energy state that causes the check stop 52 to quickly drop to a lower, "protruded" position. Micrometering injection occurs when the check stop is positioned at (moved to and then stopped at) the protruded position and fuel pressure in the nozzle chamber 30 is increased until the fuel pressure in the nozzle chamber 30 overcomes the mechanical and/or hydraulic bias keeping the check valve member 26 in the closed position. When this happens the check valve member 26 slides upward until its movement is stopped by contact with the protruded check stop 52. When this occurs the check valve member 26 is in a third position, i.e., a "micrometering" position.

This movement (from the closed position to the micrometering position) is smaller than the movement of the check valve member 26 from its closed position to its fully open position. As a result, in the micrometering position the check valve member 26 still significantly or substantially, but not entirely, restricts fuel in the nozzle chamber 30 from reaching the nozzle orifice 34. This allows a micrometering injection rate of highly pressurized fuel, less than the main fuel injection rate, to be ejected for pre-metering, split injection, or micrometering.

It is also possible to begin micrometering injection directly from main injection by operating the solid state motor 22 to move the check stop 52 from the receded position to the protruded position while maintaining fuel pressure in the nozzle chamber 30 to overcome the mechanical and/or hydraulic closing bias on the check valve member 26. When this happens the check stop 52 directly pushes the check valve member 26 down from the fully open position to the micrometering position.

Micrometering injection ends either when main fuel injection begins, or when the solid state motor 22 is changed from the second energy state back to the first energy state, allowing the downward bias on the check valve member 26 to push the check valve member 26 back to the closed position.

Different sequence combinations can be imagined. For example, micrometering injection can be performed for pre-metering for example, then ended by lowering fuel pressure in the nozzle chamber 30, before main fuel injection is performed. Or, the fuel injector can switch immediately from micrometering injection to main fuel injection by operating the solid state motor 22 to move the check stop 52 from the protracted position to the receded position without first lowering fuel pressure in the nozzle chamber 30. Similarly, the fuel injector can switch immediately from main fuel injection to micrometering injection as explained above.

Or, in the case of a fuel injector with direct hydraulic check control, the fuel injector can achieve a very short pause in fuel injection between micrometering injection and main fuel injection while fuel pressure in the nozzle chamber 30 remains high. To do this, high-pressure hydraulic fluid is supplied to the check control chamber 46 to very quickly move the check valve member 26 from its micrometering position to its closed position. Then the solid state motor 22 is operated to immediately move the check stop 52 from its protruded position to its receded position, and the high-pressure hydraulic fluid is drained from the check control chamber 46 to allow the high pressure fuel in the nozzle chamber 30 to quickly move the check valve member 26 from its closed position to its fully open position.

Additionally, because of the fast acting operation of the solid state motor 22, the check stop 52 can be quickly toggled between the protruded position and the receded position to allow the check valve member 26 to reach a controllable intermediate position between the micrometering position and the fully open position before being pushed back to the micrometering position. Rapidly repeating this action can produce a "flutter" resulting in fuel injection at a fluctuating rate having a peak injection rate less than the main injection rate. This peak rate can be varied by adjusting timing of the solid state motor 22 operation, adjusting downward bias on the check valve member 26, adjusting fuel pressure in the nozzle chamber, or a combination thereof.

Further, by varying the current or magnetic field applied to the solid state motor 22 (piezo or magnetostrictive type, for example), the solid state motor 22 can be operated to position the check stop 52 at any of a plurality of different, discrete, intermediate positions. In this way the amount of fuel injected during micrometering injection can be varied during the same fuel injection shot, or varied shot-to-shot, to adjust for engine load, throttle position, or other engine operating conditions.

Finally, it is possible to achieve an extremely short micrometering event by operating the solid state motor 22 while the check valve member 26 is in its closed position. To do this, high-pressure hydraulic fluid in the check control chamber 46 is used to keep the check valve member 26 in its closed position while the nozzle chamber 30 is filled with high pressure fuel. Then, before draining the high-pressure hydraulic fluid from the check control chamber 46, or when the high-pressure hydraulic fluid is just starting to drain from the check control chamber 46, but the total downward bias against the check valve member 26 is still greater than the fuel pressure in the nozzle chamber 30, the solid state the pin motor 22 is operated to instantly move the check stop 52 from a position very close to the closing surface 48 of the check piston 36 (the protruding position for example) to a position farther from the check piston 36 (the receded position for example).

Because the check stop 52 surface was so close to the closing surface 48 of the check piston 36, suddenly pulling it away from the check piston 36 will create a momentary low-pressure area above the check piston 36 that is lower than the fuel pressure in the nozzle chamber 30. This will allow the check valve member 26 to open very briefly causing an extremely brief micrometering injection event. By choosing intermediate positions of varying distance from the closing surface 48 to begin with, the intensity of the event can be control.

This can be performed as a single event, or the entire process can be quickly repeated any number of times, successively, to produce a controllable "micro-fluttering" of the check valve member 26.

In the illustrated embodiment, the glide ring seal 38 of the check piston 36 fluidly isolates hydraulic fluid in the check control chamber 46 from any fuel that may have seeped through the check bore 28 from the nozzle chamber 30 for example. The nylon wear surface 42 of the glide seal ring 38 provides good wear characteristics but has little or no elasticity, so the rubber energizer 40 pushes it against the check piston bore 44.

In embodiments using a fuel injector without direct hydraulic check control there may be no need for high-pressure hydraulic actuation fluid in the check control chamber 46, and thus the check piston 36 with the glide ring seal 38 may not be necessary. In that case the check piston 36 could be merely a top portion of the check valve member 26.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the receded position of the check stop 52 is so high that the check valve member 26 and/or check piston 36 are not stopped by the check stop 52 when in fully open position, but instead check valve motion is halted by some other stop or bias. Or, the receded position for the check stop 52 can be placed such that the check valve member 26 partially restricts fluid communication between the nozzle chamber 30 and the nozzle orifice 34 at its "fully open" position, so that the solid state motor 22 can move the check stop 52 to a plurality of respective micrometering positions between the receded and the protruded positions, for injecting fuel at progressively smaller rates.

Other variations to the disclosed embodiments can be understood and effected by those skilled in the art in practicing the claimed invention, from a study of the drawings, the disclosure, and the appended claims.

What is claimed is:

1. A fuel injector comprising:

a nozzle in a nozzle body, the nozzle at least partially defining a nozzle chamber and a check stop in the nozzle body, the check stop comprised by a solid state motor operable to move the check stop between a protruded position and a receded position;

a check valve member slidably disposed in the nozzle body and extending into the nozzle chamber, wherein sliding motion of the check valve member is limited in a first direction to a closed position in which the check valve member obstructs fluid communication between the nozzle chamber and the nozzle orifice, and is limited in a second direction by the check stop; and an intensifier piston slidably disposed in the fuel injector and operable to increase fuel pressure in the nozzle chamber; and an actuator operable to divert high-pressure actuation fluid to the intensifier piston.

2. A method for operating a fuel injector comprising a nozzle body, the nozzle body including a nozzle at least partially defining a nozzle chamber and at least one nozzle orifice, a check stop comprising a solid state motor, and a check valve member extending into the nozzle chamber and being slidable between a closed position in which the nozzle chamber is fluidly isolated from the nozzle orifice and a fully open position in which the nozzle chamber is in fluid communication with the nozzle orifice, the method comprising:

supplying pressurized fuel to the nozzle chamber;

operating the solid state motor to position the check stop at a receded position;

operating the solid state motor to position the check stop at a protruded position;

positioning the check valve member at the closed position;

injecting fuel from the nozzle orifice at a main injection rate by moving the check valve member to the fully open position;

injecting fuel from the nozzle orifice at a micrometering rate less than the main injection rate by positioning the check valve member at a micrometering position, between the closed position and the fully open position, in which further motion of the check valve member toward the fully open position is blocked by the check stop at the protruded position;

operating the solid state motor to position the check stop at an intermediate stop position in-between the protruded position and the receded position; and injecting fuel from the nozzle orifice at an intermediate rate in-between the micrometering rate and the main injection rate by positioning the check valve member at an intermediate check position in-between the micrometering position and the fully open position in which further motion of the check valve member toward the fully open position is blocked by the check stop at the intermediate position;

performing a continuous injection event including at least three successive discrete fuel injection rates by operating the solid state motor to sequentially position the check stop at a first one, then at a second one, and then at a third one, of the protruded position, the receded position, and the intermediate stop position, all during a single injection event.

3. A method for operating a fuel injector comprising a nozzle body, the nozzle body including a nozzle at least partially defining a nozzle chamber and at least one nozzle orifice, a check stop comprising a solid state motor, and a check valve member extending into the nozzle chamber and being slidable between a closed position in which the nozzle chamber is fluidly isolated from the nozzle orifice and a fully open position in which the nozzle chamber is in fluid communication with the nozzle orifice, the method comprising:

supplying pressurized fuel to the nozzle chamber;

operating the solid state motor to position the check stop at a receded position;

operating the solid state motor to position the check stop at a protruded position;

positioning the check valve member at the closed position;

injecting fuel from the nozzle orifice at a main injection rate by moving the check valve member to the fully open position; and injecting fuel from the nozzle orifice at a micrometering rate less than the main injection rate by positioning the check valve member at a micrometering position, between the closed position and the fully open position, in which further motion of the check valve member toward the fully open position is blocked by the check stop at the protruded position;

a micro-flutter step of operating the solid state motor to quickly move the check stop toward the receded position when the check valve member is at the closed position, thereby causing the check valve member to begin to lift from the closed position and then fall back, resulting in a momentary injection of fuel from the nozzle orifice.

4. The method of claim 3, further comprising performing a plurality of said micro-flutter steps in rapid succession to cause a micro-fluttering of the check valve member.

5. A method for operating a fuel injector comprising a nozzle body, the nozzle body including a nozzle at least partially defining a nozzle chamber and at least one nozzle orifice, a check stop comprising a solid state motor, and a check valve member extending into the nozzle chamber and being slidable between a closed position in which the nozzle chamber is fluidly isolated from the nozzle orifice and a fully open position in which the nozzle chamber is in fluid communication with the nozzle orifice, the method comprising:

supplying pressurized fuel to the nozzle chamber;

operating the solid state motor to position the check stop at a receded position;

operating the solid state motor to position the check stop at a protruded position;

positioning the check valve member at the closed position;

injecting fuel from the nozzle orifice at a main injection rate by moving the check valve member to the fully open position; and injecting fuel from the nozzle orifice at a micrometering rate less than the main injection rate by positioning the check valve member at a micrometering position, between the closed position and the fully open position, in which further motion of the check valve member toward the fully open position is blocked by the check stop at the protruded position;

using high-pressure hydraulic fluid to drive a plunger to increase fuel pressure in the nozzle chamber;

electronically operating an actuator to divert high-pressure actuating fluid to an intensifier piston to drive the plunger.

6. The method of claim 5, further comprising causing the check valve member to move from one of the micrometering position and the fully open position to the closed position by diverting high-pressure hydraulic fluid to a check control chamber fluidly isolated from the nozzle chamber.

7. A method for operating a fuel injector comprising a nozzle body, the nozzle body including a nozzle at least partially defining a nozzle chamber and at least one nozzle orifice, a check stop comprising a solid state motor, and a check valve member extending into the nozzle chamber and being slidable between a closed position in which the nozzle chamber is fluidly isolated from the nozzle orifice and a fully open position in which the nozzle chamber is in fluid communication with the nozzle orifice, the method comprising:

supplying pressurized fuel to the nozzle chamber;

operating the solid state motor to position the check stop at a receded position;

operating the solid state motor to position the check stop at a protruded position;

positioning the check valve member at the closed position;

injecting fuel from the nozzle orifice at a main injection rate by moving the check valve member to the fully open position;

injecting fuel from the nozzle orifice at a micrometering rate less than the main injection rate by positioning the check valve member at a micrometering position, between the closed position and the fully open position, in which further motion of the check valve member toward the fully open position is blocked by the check stop at the protruded position;

operating the solid state motor to cause the check stop at alternately travel back and forth between the protruded position and the receded position to produce a continuous, fluctuating fuel injection rate having a peak injection rate less than the main injection rate.

* * * * *